United States Patent [19]

Moran et al.

[11] 4,233,608

[45] Nov. 11, 1980

[54] BROADBAND ANTENNA ELEMENT

[75] Inventors: Robert L. Moran, Rand, Colo.; Francis J. O'Hara, Bedford, Mass.

[73] Assignee: Raytheon Company, Lexington, Mass.

[21] Appl. No.: 727,731

[22] Filed: Sep. 29, 1976

[51] Int. Cl.[3] ..... H01Q 21/00

[52] U.S. Cl. ..... 343/728; 343/789; 343/741

[58] Field of Search ..... 343/772, 786, 789, 845, 343/729, 728, 741

[56] References Cited

U.S. PATENT DOCUMENTS

| | | | |
|---|---|---|---|
| 2,472,201 | 6/1949 | Eyges | 343/786 |
| 3,261,018 | 7/1966 | Mast | 343/789 X |
| 3,573,835 | 4/1971 | Stark et al. | 343/786 |

*Primary Examiner*—Theodore M. Blum

*Attorney, Agent, or Firm*—Philip J. McFarland; Joseph D. Pannone

[57] ABSTRACT

A broadband antenna element capable of operating over greater than an octave band of frequencies is disclosed. The element comprises an open-ended rectangular waveguide section having a loop radiator, formed by shorting an insulated probe to one of the broad walls of the waveguide section, disposed therein. Notches are provided in the narrow walls and flanges are provided on the broad walls of the waveguide section for matching purposes. The insulated probe extends through a hole formed in the rear wall of the waveguide section to connect with a stripline feed network.

2 Claims, 2 Drawing Figures

BROADBAND ANTENNA ELEMENT

BACKGROUND OF THE INVENTION

This invention relates generally to antenna elements and in particular to a broadband waveguide antenna element suitable for use in antiradiation missile seeker applications.

Manned aircraft have been, and will continue to be, one of the principal means of weapons delivery in modern warfare. Manned aircraft combine a capability for accurate delivery of projectiles with the capability of reconnaissance and surveillance, utilizing personnel within the aircraft for location and identification of ground targets. Improved radar processing techniques, such as synthetic aperture mapping, then may be used to supplement the senses of the personnel to provide capability of attacking ground targets under adverse weather conditions and at night. Therefore, if allowed to roam freely in the airspace over the battlefield, manned aircraft can be the decisive factor in any ground engagement.

To counter the threat posed by manned aircraft, highly effective ground-based anti-aircraft defense systems are being developed and deployed to reduce the probability of penetration of battle areas by manned aircraft to make the sustained use of such aircraft impractical. The common feature of such systems is the use of some form of radiation, such as radar, for the functions of search, acquisition, tracking or fire control of airborne vehicles, including manned aircraft. One most effective way to counteract the systems being discussed is, of course, to provide guided missiles which, when launched from an aircraft, sense the radiation and home in on the source of such radiation to deliver appropriate ordnance to such source. The radiation from the aforementioned defense systems may lie at any frequency within a wide frequency band and because such radiation may have one of several polarization senses, a missile seeker designed to home in on the source of such radiation (sometimes hereinafter referred to as an antiradiation missile (ARM) seeker) must be capable of operating over a similarly wide band of frequencies and must be responsive to any one of several polarization senses.

An antenna including a matrix of stripline tapered notch elements, as described in an article entitled, "A Broadband Stripline Array Element," by L. R. Lewis, M. Fassett and J. Hunt, IEEE Antenna Propagation Society Symposium at Atlanta, Ga., June 1974, has been developed for ARM seeker applications. In such elements, a notch is etched away on both ground planes of a stripline and the stripline center conductor is arranged to excite a voltage across the notch. The matrix of elements is mounted orthogonally with respect to a feed network, requiring a right angle transition to be made between each element and the feed network. Such right angle transitions are extremely difficult to match over a wide frequency band with the result that impedance mismatches between the elements and the feed network may seriously degrade the seeker antenna performance. In addition, the physical size of such elements and the manner in which the matrix of such elements is mounted orthogonally to the feed network makes vibrational damage in missile seeker applications quite likely.

The gain of the stripline tapered notch element being discussed is a function of the length of the element. Thus, an element having a length of approximately one-half wavelength at the highest operating frequency has a gain of from 1 to 3 db over an octave band, while an element of the same width but having a longer notch has greater than 4 db of gain over the same frequency band. In instances where space available for an antenna does not allow long elements, as in missile seeker applications, the gain of such elements is limited.

Thus, there exists a need for a broadband antenna element, suitable for missile seeker applications, which may be integrated to a stripline feed network without causing severe mismatch problems and which is not susceptible to vibrational damage.

SUMMARY OF THE INVENTION

With this background of the invention in mind, it is an object of this invention to provide an antenna element having greater than an octave bandwidth.

It is another object of this invention to provide an antenna element which may be integrated with a stripline feed network without mismatch problems.

It is a further object of this invention to provide an antenna element which exhibits greater than 6 db gain over greater than an octave band of frequencies.

These and other objects of the invention are attained generally by providing a hybrid radiating element comprising a loop radiator mounted within a rectangular waveguide terminated by a short circuit. A first end of the loop radiator is connected to the E-plane wall of the waveguide section. A second end of the loop radiator is connected to a probe extending through an iris in the shorted end of the rectangular waveguide. The loop radiator both excites the predominant $TE_{10}$ mode within the rectangular waveguide which radiates into space and itself radiates directly into space so that the operating frequency of the element is extended beyond the cutoff frequency of the rectangular waveguide.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Figure 1:
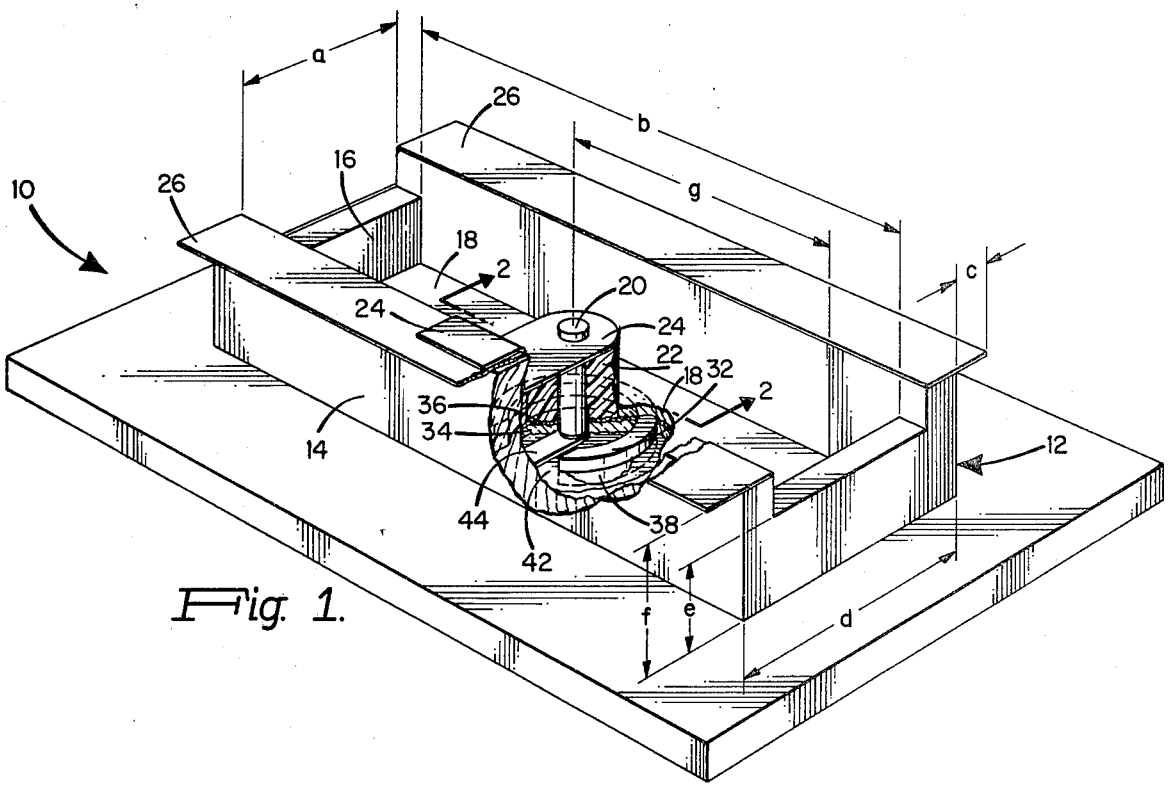
FIG. 1 is an isometric drawing of a broadband antenna element according to the invention.

Referring now to FIG. 1, a broadband hybrid antenna element 10 (hereinafter sometimes referred to simply as antenna element 10) is shown to include a waveguide section 12 having a pair of broad walls (as that marked 14), a pair of narrow walls (as that marked 16), and a short circuited end 18. A probe 20, covered by a teflon dielectric sleeve 22, extends into waveguide section 12 from an iris (not shown) in the short circuited end 18. The length of probe 20 is approximately one-quarter wavelength at the center band frequency. The diameters of the probe 20 and the teflon dielectric sleeve 22 are dimensioned to provide a 50 ohm structure through the iris in short circuited end 18. Diametrically opposed flats (not numbered) are provided on teflon dielectric sleeve 22 to permit the insertion of the sleeve within the waveguide section 12 and to prevent rotation of the sleeve. A strip of metal tape 24, a first end of which is soldered to probe 20 and a second end of which is soldered to a broad wall 14, as shown, connects the probe 20 to the waveguide section 12. The strip of metal tape 24, the probe 20, and the broad wall 14 form a loop to allow the $TE_{10}$ mode to be excited within the waveguide section 12. The width of the strip of metal tape 24 is controlled for the purpose of matching antenna element 10 over the 8 to 18 GHz band. The optimum width for the strip of metal tape was determined to be 0.100±0.002 inches. Metal tabs 26 are included on the broad walls 14 for matching purposes. Notches (not numbered) are provided in the narrow walls 16, also for matching purposes.

In operation, at frequencies above the cutoff frequency of waveguide section 12, the antenna element 10 operates as a $TE_{10}$ mode waveguide radiator. At frequencies below the cutoff frequency for the $TE_{10}$ mode, the radiation from antenna element 10 is primarily from the loop formed by the probe 20, the metal tape 24, and the broad wall 14.

Figure 2:
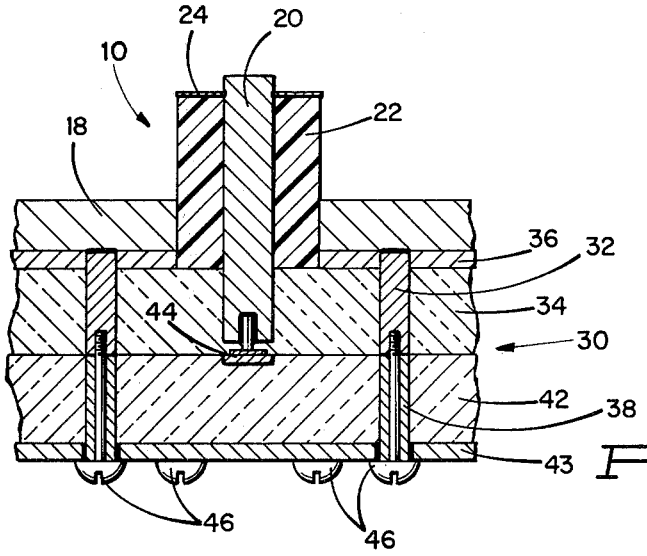
FIG. 2 is a partial cross-sectional view, taken along the plane 2—2 in FIG. 1, showing the way in which the element is connected to a stripline.

Referring now to FIG. 2, the interconnection between antenna element 10 and a stripline 30 is illustrated. Probe 20 and teflon dielectric sleeve 22 are shown to extend through an iris (not numbered) in the short circuited end 18 of the waveguide section 12 (FIG. 1). The teflon dielectric sleeve 22 is terminated flush with the outer surface of the short circuited end 18. A horseshoe-shaped ring 32, having a plurality of tapped holes (not numbered) formed therein, is soldered as shown to the outer surface of the short circuited end 18. The upper dielectric board 34 and the upper groundplane 36 of the stripline 30 have cutouts (not numbered) provided to accommodate the horseshoe-shaped ring 32. A second horseshoe-shaped ring 38 having a plurality of clearance holes (not numbered) contained therein is soldered to a tinned cutout (not numbered) provided in the lower dielectric board 42 and the lower groundplane 43 of stripline 30. A pin 44 is attached to the center conductor circuitry on the upper surface of dielectric board 42. Pin 44 is pre-tinned and is designed to be soldered within a cylindrical cavity (not numbered) provided in probe 20. Once pin 44 is soldered to probe 20, horseshoe-shaped rings 32 and 38 are joined together by means of screws 46 which pass through the clearance holes provided in ring 38 and engage the tapped holes provided in ring 32.

For ARM seeker applications, an elliptically or circularly polarized seeker antenna is desired so that either a linearly or circularly polarized source may be attacked. In order to obtain essentially circular polarization, adjacent ones of the antenna elements would be orthogonally disposed with respect to each other and each orthogonal pair of antenna elements would be fed in phase quadrature. Methods for determining element-to-element spacing and for obtaining quadrature feed signals are matters involving ordinary skill in the art and will therefore not be recounted.

The antenna element 10 has been built and found effective to provide a minimum of 6.0 db of gain over the 8 to 18 GHz frequency band.

The dimensions of the element just mentioned were:

Dimension a=0.150 inches
Dimension b=0.620 inches
Dimension c=0.100 inches
Dimension d=0.235 inches
Dimension e=0.250 inches
Dimension f=0.350 inches
Diameter of coaxial probe 20=0.050 inches
Diameter of teflon sleeve 22=0.162 inches Having described a preferred embodiment of this invention, it is now evident that other embodiments incorporating its concepts may be used. For example, the antenna element could be fed by a coaxial cable instead of the stripline network shown. Also, if it were desired to reduce the weight of the element, the waveguide section could be formed from a plated foam material.

It is felt, therefore, that this invention should not be restricted to its disclosed embodiment but rather should be limited only by the spirit and the scope of the appended claims.

What is claimed is:

1. An antenna element, suitable for operation over greater than an octave band of frequencies, comprising:

(a) a waveguide section having a rectangular cross-section defined by opposing pairs of narrow and broad walls dimensioned to support the $TE_{10}$ mode above a cutoff frequency within the band of operating frequencies, a first end of said waveguide section being terminated in a short circuit and a second end of said waveguide section being terminated in an open circuit for radiating radio frequency energy; and (b) a loop radiator disposed within said waveguide section adjacent the second end thereof, said loop radiator exciting the $TE_{10}$ mode within said waveguide section at frequencies greater than the cutoff frequency of said waveguide section and said loop radiator further being the principal source of radiation at frequencies below the cutoff frequency of the waveguide section.

2. The antenna element recited in claim 1 wherein said loop radiator comprises:

(a) a dielectrically covered probe extending centrally through the short circuit terminated end of said waveguide section and terminating at a distance of approximately $\lambda/4$ from such end, where $\lambda$ is the wavelength corresponding to the center frequency of the band of operating frequencies; and (b) a stip of metal having a first end connected to said dielectrically covered probe and a second end attached to one of the broad walls of said waveguide section.

* * * * *